US008093181B2

(12) United States Patent
Shinohara et al.

(10) Patent No.: US 8,093,181 B2
(45) Date of Patent: Jan. 10, 2012

(54) THERMAL TRANSFER MEMBER, THERMAL TRANSFER MEMBER SET, AND RECORDING METHOD

(75) Inventors: Satoru Shinohara, Miyagi (JP); Katsuya Tanba, Miyagi (JP); Masanobu Hida, Miyagi (JP)

(73) Assignee: Sony Corporation, Tokyo (JP)

( * ) Notice: Subject to any disclaimer, the term of this patent is extended or adjusted under 35 U.S.C. 154(b) by 556 days.

(21) Appl. No.: 12/354,487

(22) Filed: Jan. 15, 2009

(65) Prior Publication Data

US 2009/0186172 A1 Jul. 23, 2009

(30) Foreign Application Priority Data

Jan. 21, 2008 (JP) ..... 2008-010872

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS 5,369,078 A 11/1994 Eguchi et al.

FOREIGN PATENT DOCUMENTS

| | | |
|---|---|---|
| EP | 2030800 | 3/2009 |
| JP | 60-239289 | 11/1985 |
| JP | 63-071393 | 3/1988 |
| JP | 11-334216 | 12/1999 |
| JP | 3596921 | 9/2004 |
| JP | 2005-271361 | 10/2005 |

OTHER PUBLICATIONS

Search Report issued by the European Patent Office on Jun. 2, 2009 in connection to related European Patent Application No. 09000726.1.

*Primary Examiner* — Bruce H Hess
(74) *Attorney, Agent, or Firm* — SNR Denton US LLP

(57) ABSTRACT

A thermal transfer member includes a plurality of color material layers on one surface of a base material, wherein at least one of the color material layers contains a dicyanomethine based coloring agent represented by Structural formula 1 and at least one of the other color material layers contains an indoaniline based coloring agent represented by Structural formula 2.

Structural formula 1

Where $R_1$ represents an alkyl group, Y represents —$C_2H_4$— or —$C_2H_4O$—, and $R_2$ represents a substituted or unsubstituted aryl group.

Structural formula 2

Where X represents a halogen atom or a hydrogen atom, $R_3$, $R_4$, and $R_5$ represent independently an alkyl group having the carbon number of 1 to 4.

15 Claims, 1 Drawing Sheet

THERMAL TRANSFER MEMBER, THERMAL TRANSFER MEMBER SET, AND RECORDING METHOD

CROSS REFERENCES TO RELATED APPLICATIONS

The present invention contains subject matter related to Japanese Patent Application JP 2008-010872 filed in the Japanese Patent Office on Jan. 21, 2008, the entire contents of which are incorporated herein by reference.

BACKGROUND OF THE INVENTION

1. Field of the Invention

The present invention relates to a thermal transfer member, in which a plurality of color material layers containing specific coloring agents are disposed on one surface of a base material and which is used for a recording method through sublimation or heat migration thermal transfer, and a recording method in which the coloring agents of the thermal transfer member are thermally transferred to a transfer receiving member, e.g., photographic paper, so as to record a lightfast image.

2. Description of the Related Art

In recent years, a sublimation (or heat migration) thermal transfer system has been wide spread as a color hard copy system capable of obtaining images close to silver halide photography in, for example, a hard copy output from a digital camera. Furthermore, this thermal transfer system has a feature that color printing or photorealistic printing can be conducted on demand simply without a high equipment cost and a large space in contrast to general printing methods, e.g., offset printing and gravure printing.

In the thermal transfer system, a transfer member provided with color material layers of, for example, yellow, magenta, and cyan, which contain coloring agents, and a transfer receiving member, e.g., photographic paper, are stacked together, heat energy in accordance with the image information is applied from either side with a thermal head, a laser, or the like so as to transfer the coloring agent on the transfer member to the transfer receiving member and print an image. In this thermal transfer system, the three primary colors of yellow, magenta, and cyan are used mainly, and colors employed for a photograph are reproduced by using them alone or color mixing.

Regarding the thermal transfer system in which an image is printed by the above-described method, a keeping quality particularly important for the photograph is poor as compared with that of silver halide photography. Therefore, the keeping quality is susceptible to improvement.

As for a measure against it, some proposals related to the structure of coloring agents have been made in order to improve the lightfastness of the printed image, as disclosed in Japanese Unexamined Patent Application Publication No. 60-239289.

Individual agents exhibit excellent lightfastness and excellent heat resistance when used alone. However, in some cases, the lightfastness may deteriorate because of presence together with other coloring agents on a transfer receiving member after an image is printed, even when the coloring agent exhibits good lightfastness in monochrome. That is, regarding the lightfastness, in the case where one type of dye absorbs light on a transfer receiving member, the dye serves as a sensitizing agent (or an oxidizing agent or a reducing agent) of another coloring agent because of an interaction, and the other type of coloring agent or both coloring agents deteriorate significantly. Such a problem easily occurs, for example, in the case where a yellow coloring agent and a cyan coloring agent are present together on a transfer receiving member.

A dicyanomethine based yellow coloring agent used as a yellow coloring agent exhibits slightly poor lightfastness but exhibits excellent solubility in general-purpose solvents, e.g., methyl ethyl ketone and toluene, and a high print density can be obtained.

An indoaniline based cyan coloring agent used as a cyan coloring agent exhibits excellent lightfastness and exhibits relatively excellent heat resistance. Furthermore, a high print density can be obtained.

Regarding the thermal transfer system, in the case where color mixing is conducted by combining the above-described dicyanomethine based yellow coloring agent and the indoaniline based cyan coloring agent on a transfer receiving member, a lightfastness deterioration phenomenon due to an interaction between the yellow coloring agent and the cyan coloring agent may occur in the resulting mixed color.

Moreover, quinophthalone based yellow coloring agents described in, for example, Japanese Patent No. 3596921 and Japanese Examined Patent Application Publication No. 5-35079 exhibit excellent lightfastness, but most of them exhibit poor solubility in the general-purpose solvents and are unsuitable for responding to recent speedup and an increase in sensitivity, so that they are used merely in an auxiliary manner. The quinophthalone based yellow coloring agents exhibit relatively low level of interaction with the indoaniline based coloring agents, but interactions with coloring agents having other skeleton structures are observed.

As described above, for example, in the case where a dicyanomethine based yellow coloring agent and an indoaniline based cyan coloring agent are used, no problem occurs in, for example, the solubility in solvents. However, in the case where a yellow coloring agent and a cyan coloring agent are present together on a transfer receiving member, one of the coloring agents or both coloring agents deteriorate significantly and the lightfastness of an image is reduced.

SUMMARY OF THE INVENTION

It is desirable to provide a thermal transfer member capable of reducing an interaction between different types of coloring agents, in particular between a yellow coloring agent and a cyan coloring agent and forming an image exhibiting excellent lightfastness and heat resistance, a thermal transfer member set, and a recording method by using the thermal transfer member and the thermal transfer member set.

A thermal transfer member according to an embodiment of the present invention includes a plurality of color material layers on one surface of a base material, wherein at least one of the color material layers contains a dicyanomethine based coloring agent represented by Structural formula 1 and at least one of the other color material layers contains an indoaniline based coloring agent represented by Structural formula 2.

Structural formula 1

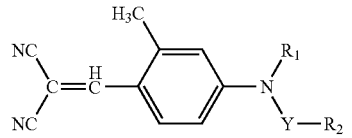

Where $R_1$ represents an alkyl group, Y represents —$C_2H_4$— or —$C_2H_4O$—, and $R_2$ represents a substituted or unsubstituted aryl group.

-continued

Structural formula 2

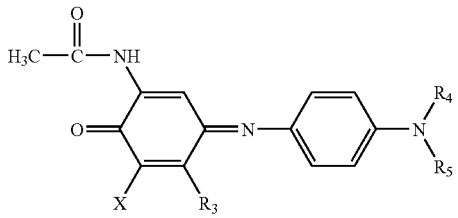

Where X represents a halogen atom or a hydrogen atom, $R_3$, $R_4$, and $R_5$ represent independently an alkyl group having the carbon number of 1 to 4.

A thermal transfer member according to another embodiment of the present invention includes a plurality of color material layers on one surface of a base material, wherein at least one of the color material layers contains a dicyanomethine based coloring agent represented by Structural formula 1 and a disazo based coloring agent represented by Structural formula 3 and at least one of the other color material layers contains an indoaniline based coloring agent represented by Structural formula 2 and an anthraquinone based coloring agent represented by Structural formula 4.

Stuctural formula 3

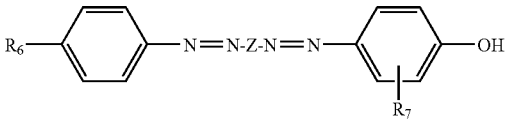

Where $R_6$ represents a hydrogen atom or an alkoxy group, Z represents a 1, 4-phenylene group or a 1, 4-naphthalene group, and $R_7$ represents a hydrogen atom or an alkyl group having the carbon number of 1 to 4.

Structural formula 4

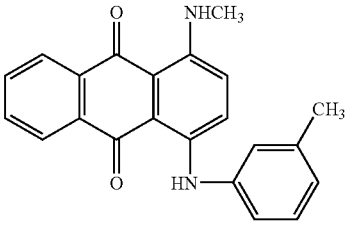

A recording method according to another embodiment of the present invention includes the step of heating color material layers of a thermal transfer member, in which a plurality of color material layers containing the above-described coloring agents are disposed on a base material, selectively in accordance with recording signals with a recording head so as to thermally transfer and record the coloring agents to a transfer receiving member.

A thermal transfer member set according to another embodiment of the present invention includes a plurality of types of thermal transfer members, in which at least one color material layer containing a coloring agent is disposed on one surface of a base material, corresponding to a plurality of recording heads including a plurality of heater elements, wherein at least one of the color material layers contains a dicyanomethine based coloring agent represented by Structural formula 1 and at least one of the other color material layers contains an indoaniline based coloring agent represented by Structural formula 2.

A thermal transfer member set according to another embodiment of the present invention includes a plurality of types of thermal transfer members, in which at least one color material layer containing a coloring agent is disposed, corresponding to a plurality of recording heads including a plurality of heater elements, wherein at least one of the color material layers contains a dicyanomethine based coloring agent represented by Structural formula 1 and a disazo based coloring agent represented by Structural formula 3 and at least one of the other color material layers contains an indoaniline based coloring agent represented by Structural formula 2 and an anthraquinone based coloring agent represented by Structural formula 4.

A recording method according to another embodiment of the present invention is a recording method by using a plurality of recording heads including a plurality of heater elements, the method including the step of preparing a plurality of types of thermal transfer members, in which at least one color material layer is disposed on one surface of a base material, and heating the resulting thermal transfer members selectively in accordance with recording signals with recording heads corresponding to the individual thermal transfer members so as to thermally transfer and record the above-described coloring agents on a transfer receiving member.

In an embodiment of the present invention, among the plurality of color material layers, at least one of the color material layers contains the dicyanomethine based coloring agent represented by Structural formula 1 and at least one of the other color material layers contains the indoaniline based coloring agent represented by Structural formula 2. Even when these two coloring agents are thermally transferred to the transfer receiving member through heating with the recording head and are present together on the transfer receiving member, an interaction between different coloring agents is reduced, deterioration of the coloring agents is reduced. Consequently, an image exhibiting excellent lightfastness and heat resistance and, therefore, having excellent fastness properties can be formed. Furthermore, in an embodiment of the present invention, not only in the case of a mixed color, but also even in the case of a monochrome, an image having excellent fastness properties, e.g., lightfastness and heat resistance, can be formed.

Moreover, in an embodiment of the present invention, in the case where a color material layer is formed by mixing a plurality of coloring agents from the viewpoint of the color balance, the lightfastness, and the color optical density, at least one of the color material layers is allowed to contain the dicyanomethine based coloring agent represented by Structural formula 1 and the disazo based coloring agent represented by Structural formula 3 and at least one of the other color material layers is allowed to contain the indoaniline based coloring agent represented by Structural formula 2 and the anthraquinone based coloring agent represented by Structural formula 4 and, thereby, an image having further excellent fastness properties, e.g., lightfastness and heat resistance, can be formed likewise, where not only a monochrome is concerned, but also even a mixed color is concerned.

DESCRIPTION OF THE PREFERRED EMBODIMENTS

A thermal transfer member and a recording method by using the thermal transfer member according to an embodiment of the present invention will be described below in detail with reference to the drawings.

Figure 1:
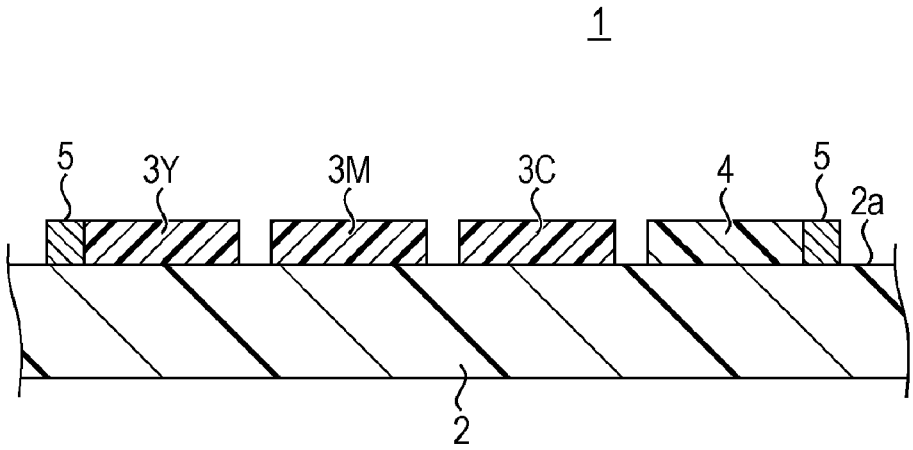
FIG. 1 is a schematic diagram of a thermal transfer printer.

As shown in FIG. 1, in a thermal transfer member 1, coloring agent-containing color material layers 3Y, 3M, and 3C of three colors, yellow, magenta, and cyan, and an over coat layer 4 for protecting a formed image are field-sequentially disposed side by side on one surface 2*a* of a base material 2. This thermal transfer member 1 is incorporated into a thermal transfer printer 10 shown in FIG. 2, and the coloring agents are thermally transferred to a transfer receiving member 11, e.g., photographic paper, fed into the thermal transfer printer 10 so as to form an image.

Figure 2:
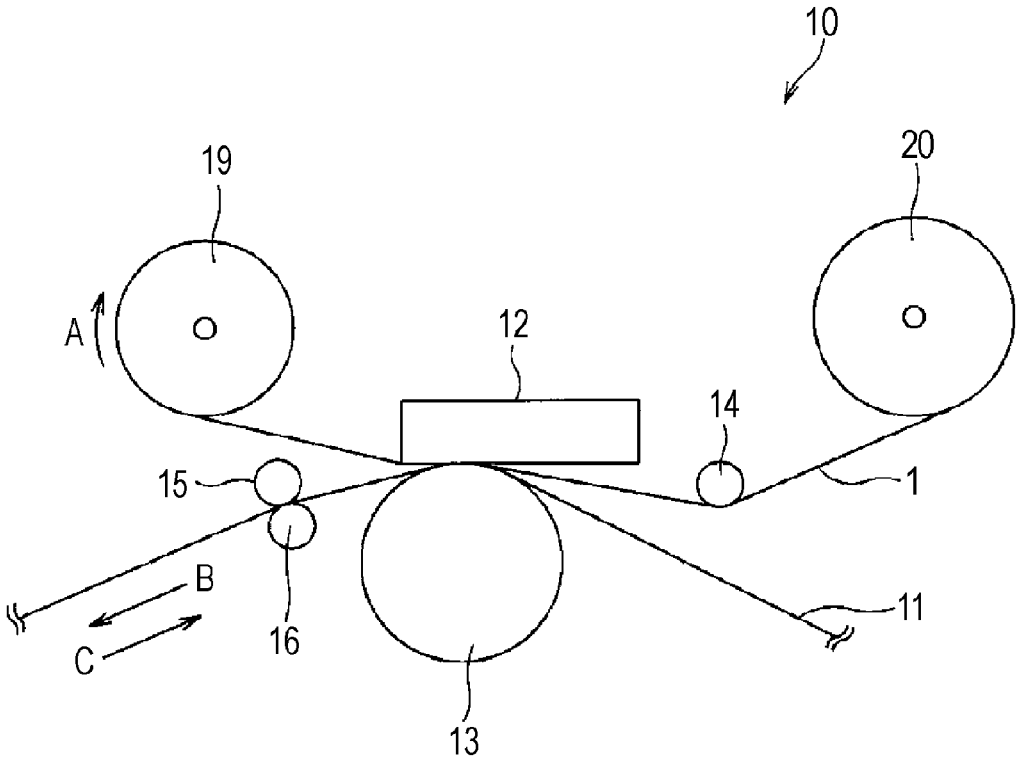
FIG. 2 is a sectional view of a thermal transfer member according to an embodiment of the present invention.

As shown in FIG. 2, the thermal transfer printer 10 includes a thermal head 12, which heats the color material layer 3 and the over coat layer 4 from a back surface not provided with color material layer 3 and the like of the thermal transfer member 1, a platen 13, which is disposed at a position opposite to the thermal head 12 and which holds the thermal transfer member 1 between the thermal head 12 and the platen 13, a guide roller 14 for guiding the movement of the incorporated thermal transfer member 1, and a pinch roller 15 and a capstan roller 16 which feed a transfer receiving member 11 together with the thermal transfer member 1 between the thermal head 12 and the platen 13.

In the thermal transfer printer 10 having the above-described configuration, as shown in FIG. 2, a take-up side spool 19 of the thermal transfer member 1 is rotated in a take-up direction indicated by a direction of an arrow A in FIG. 2 and, thereby, the thermal transfer member 1 is moved between the thermal head 12 and the platen 13 from the supply side spool 20 to the take-up spool 19. The transfer receiving member 11 is sandwiched between the pinch roller 15 and the capstan roller 16, the capstan roller 16 is rotated in a paper discharge direction indicated by a direction of an arrow B in FIG. 2 and, thereby, the transfer receiving member 11 is moved in the paper discharge direction so as to oppose a starting end of an image formation region, in which an image is formed, of the transfer receiving member 11 to the thermal head 12.

In printing of an image on the transfer receiving member 11, heat energy is selectively applied to the yellow color material layer 3Y of the thermal transfer member 1 on the basis of image data with the thermal head 12 so that the yellow coloring agent is thermally transferred to the transfer receiving member 11 which is moved while being stacked with the thermal transfer member 1. After the yellow coloring agent is thermally transferred, in order to thermally transfer the magenta coloring agent to the image formation region of the transfer receiving member 11 to which the yellow coloring agent have been thermally transferred, the transfer receiving member 11 is moved toward the thermal head 12 side (in a direction of an arrow C in FIG. 2), the starting end of the image formation region is opposed to the thermal head 12 again, and the magenta color material layer 3M of the thermal transfer member 1 is also opposed to the thermal head 12. In a manner similar to that in the case where the yellow coloring agent is thermally transferred, heat energy is selectively applied to the magenta color material layer 3M on the basis of image data with the thermal head 12, so that the magenta coloring agent is thermally transferred to the image formation region of the transfer receiving member 11. The thermal transfer of the cyan coloring agent to the transfer receiving member 11 is conducted in a manner similar to that in the case where the magenta coloring agent is thermally transferred. Consequently, the cyan coloring agent is thermally transferred to the transfer receiving member 11 so as to form a color image. The resulting color image is formed through, for example, color mixing of the magenta coloring agent and the cyan coloring agent. After the color image is formed, the over coat layer 4 is thermally transferred all over the image formation region as in the magenta coloring agent, so that a color image protected by the over coat layer 4 is printed.

In the thermal transfer printer 10, any heating device in related art, although not limited to the thermal head, can be used. As for the thermal transfer printer 10, a recorder, e.g., a thermal printer (Full Color Digital Photo Printer UP-DR 150 produced by Sony Corporation), can be used, and a desired image exhibiting excellent lightfastness can be formed by controlling the recording time. In this thermal transfer printer 10, the pinch roller 15 and the capstan roller 16 may be disposed on the opposite side with respect to the thermal head 12, or a color image may be formed while the capstan roller 16 is rotated in a direction indicated by the arrow B and the transfer receiving member 11 is moved in the paper discharge direction.

The thermal transfer member 1 used in conducting printing with the thermal transfer printer 10, as described above, will be specifically described.

As shown in FIG. 1, in the thermal transfer member 1, the color material layers 3Y, 3M, and 3C of three colors, yellow, magenta, and cyan, and the over coat layer 4 are sequentially disposed side by side on one surface 2*a* of the base material 2. In this thermal transfer member 1, each of the yellow color material layer 3Y and the color material layer 3C contains a specific coloring agent.

The base material 2 may be a material which is previously in the public domain and which has the heat resistance and the strength to some extent. Examples thereof include paper, various types of converted paper, polyester films, polystyrene films, polypropylene films, polysulfone films, polycarbonate films, polyvinyl alcohol films, polyimide films, polyamide imide films, polyether ether ketone films, and cellophane, which are in a long lengths of shape and have a thickness of 0.5 μm to 50 μm, and preferably about 3 μm to 15 μm. Particularly preferable examples include polyester films.

The color material layer 3 disposed on the one surface 2*a* of the base material 2 includes the yellow color material layer 3Y, the magenta color material layer 3M, and the cyan color material layer 3C. In the thermal transfer member 1, the magenta color material layer 3M is disposed as necessary.

The color material layer 3 is formed containing a coloring agent and a binder resin for holding the coloring agent as primary components.

The yellow color material layer 3Y contains at least a dicyanomethine based coloring agent represented by Structural formula 1 as a coloring agent.

Structural formula 1

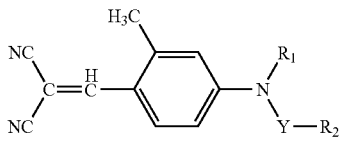

Where $R_1$ represents an alkyl group, Y represents —$C_2H_4$— or —$C_2H_4O$—, and $R_2$ represents a substituted or unsubstituted aryl group.

The dicyanomethine based coloring agent represented by Structural formula 1 exhibits slightly poor lightfastness, but exhibits excellent solubility in solvents, e.g., methyl ethyl ketone and toluene, and a high print density can be obtained.

Furthermore, the yellow coloring agent may contain a disazo based coloring agent represented by Structural formula 3 besides the dicyanomethine based coloring agent represented by Structural formula 1.

Structural formula 3

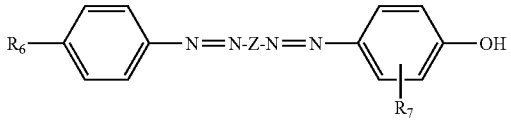

Where $R_6$ represents a hydrogen atom or an alkoxy group, Z represents a 1,4-phenylene group or a 1,4-naphthalene group, and $R_7$ represents a hydrogen atom or an alkyl group having the carbon number of 1 to 4.

This disazo based coloring agent represented by Structural formula 3 combined with the dicyanomethine based coloring agent represented by Structural formula 1 adjusts the color tone of the yellow color material layer 3Y and, in addition, a function of suppressing recrystallization of the coloring agents in the yellow color material layer 3Y during preservation of the thermal transfer member 1 is exerted. Moreover, the coloring agent having the present skeleton structure exhibits excellent lightfastness of an image.

In the case where a plurality of yellow coloring agents are contained, it is preferable that the content of the dicyanomethine based coloring agent represented by Structural formula 1 is within the range of 20 percent by weight to 100 percent by weight in the entire yellow coloring agents. In the case where the content of the dicyanomethine based coloring agent represented by Structural formula 1 is specified to be within the range of 20 percent by weight to 100 percent by weight, desired lightfastness is obtained and a desired color optical density is also obtained.

In the case where the dicyanomethine based coloring agent represented by Structural formula 1 is used as the yellow coloring agent, an image exhibiting high lightfastness, having an excellent color optical density, and having a wide color reproduction range can be obtained. In the case where the disazo based coloring agent represented by Structural formula 3 is further contained as a yellow coloring agent, an image exhibiting higher lightfastness, having a further excellent color optical density, and having a wider color reproduction range can be obtained.

Besides the dicyanomethine based coloring agent represented by Structural formula 1 and the disazo based coloring agent represented by Structural formula 3, previously used other coloring agents within the bounds of not impairing the effects of the present invention may be added to the yellow color material layer 3Y and be used in combination in order to adjust the hue.

The cyan color material layer 3C contains at least an indoaniline based coloring agent represented by Structural formula 2 as a coloring agent.

Structural formula 2

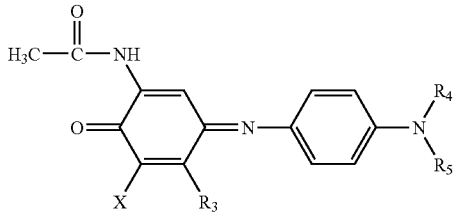

Where X represents a halogen atom or a hydrogen atom, $R_3$, $R_4$, and $R_5$ represent independently an alkyl group having the carbon number of 1 to 4.

The indoaniline based coloring agent represented by Structural formula 2 exhibits excellent lightfastness and exhibits relatively excellent heat resistance. Furthermore, a high print density can be obtained.

Furthermore, the cyan coloring agent may contain an anthraquinone based coloring agent represented by Structural formula 4 besides the indoaniline based coloring agent represented by Structural formula 2.

Structural formula 4

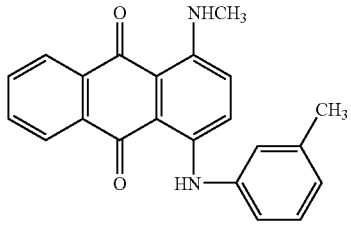

This anthraquinone based coloring agent represented by Structural formula 4 combined with the indoaniline based coloring agent represented by Structural formula 2 adjusts the color tone of the cyan color material layer 3C and, in addition, a function of suppressing recrystallization of the coloring agents in the cyan color material layer 3C during preservation of the thermal transfer member 1 is exerted. Moreover, the coloring agent having the present skeleton structure exhibits excellent lightfastness of an image.

In the case where a plurality of cyan coloring agents are contained, it is preferable that the content of the indoaniline based coloring agent represented by Structural formula 2 is within the range of 20 percent by weight to 100 percent by weight in the entire cyan coloring agents. In the case where the content of the indoaniline based coloring agent represented by Structural formula 2 is specified to be within the range of 20 percent by weight to 100 percent by weight, desired lightfastness is obtained and a desired color optical density is also obtained.

In the case where the indoaniline based coloring agent represented by Structural formula 2 is used as the cyan coloring agent, an image exhibiting high lightfastness, having an excellent color optical density, and having a wide color reproduction range can be obtained. In the case where the anthraquinone based coloring agent represented by Structural formula 4 is further contained as a cyan coloring agent, an image exhibiting higher lightfastness, having a further excellent color optical density, and having a wider color reproduction range can be obtained.

Besides the indoaniline based coloring agent represented by Structural formula 2 and the anthraquinone based coloring agent represented by Structural formula 4, previously used other coloring agents within the bounds of not impairing the effects of the present invention may be added to the cyan color material layer 3C as well and be used in combination in order to adjust the hue.

As for the magenta color material layer 3M, coloring agents used for magenta color material layers of general thermal transfer members can be used. Examples of magenta coloring agents include azo dyes, anthraquinone dyes, styryl dyes, and heterocyclic azo dyes. These coloring agents can be used alone or in combination.

In individual color material layers 3Y, 3M, and 3C, any binder resin previously in the public domain can be used for supporting the coloring agent. Examples of binder resins include cellulose resins, e.g., methyl cellulose, ethyl cellulose, hydroxyethyl cellulose, hydroxypropyl cellulose, ethylhydroxyethyl cellulose, cellulose acetate, cellulose acetate butyrate, cellulose acetate propionate, and cellulose nitrate; vinyl resins, e.g., polyvinyl alcohols, polyvinyl acetates, polyvinyl butyrals, polyvinyl acetoacetals, polyvinyl pyrrolidones, polystyrenes, and polyvinyl chlorides; acrylic resins, e.g., polyacrylonitriles, polyacrylates, and polymethacrylates; polyamide resins; polyester resins; polycarbonate resins; phenoxy resins; polysulfone resins; phenol resins; epoxy resins; and elastomers. They may be used after mixing or copolymerization. Furthermore, various curing agents may be added. As for the binder resin, polyvinyl butyrals and polyvinyl acetoacetals are particularly preferable from the viewpoint of the heat resistance, the migration property of the coloring agent, and the like.

The above-described binder resin can be used after addition of a mold-releasable graft copolymer or a mold release agent. As for the mold-releasable graft copolymer, a polymer in which a polymer main chain is graft copolymerized with at least one type of mold-releasable segment selected from a polysiloxane segment, a fluorocarbon segment, a fluorohydrocarbon segment, and a long chain alkyl segment can be used. Examples of copolymers are described in, for example, Japanese Unexamined Patent Application Publication No. 7-290847.

As for the mold release agent, additives of silicone base, fluorine base, long chain alkyl base, and the like can be used. Specific examples of mold release agents are described in, for example, Japanese Unexamined Patent Application Publication No. 8-310136.

The mold-releasable segment content of the mold-releasable graft copolymer, the amount of addition of the mold-releasable graft copolymer, and the amount of addition of the mold release agent are determined in accordance with the mold release effect. This is because in the case where the mold-releasable segment content and the amounts of addition are small, the mold release effect becomes insufficient, and in the case where they are large, the migration property of the coloring agents of the color material layer 3 and the coating strength are reduced and a problem occurs in the preservation property of the image formed on the transfer receiving member.

Although not shown in the drawing, in the thermal transfer member 1, a black color material layer may be disposed following the yellow color material layer 3Y, the magenta color material layer 3M, and the cyan color material layer 3C, as necessary. This black color material layer can be formed from a single coloring agent or by mixing a plurality of types of coloring agents, and be formed by mixing optional coloring agents including the coloring agents represented by Structural formula 1 to Structural formula 4 appropriately.

The above-described yellow color material layer 3Y, the magenta color material layer 3M, the cyan color material layer 3C, and the black color material layer are formed having thicknesses of 0.2 to 5.0 μm, and preferably about 0.3 to 2.0 μm.

The content of the total coloring agents in the yellow color material layer 3Y, the magenta color material layer 3M, the cyan color material layer 3C, and the black color material layer of the color material layer 3 is 20 to 80 percent by weight, and preferably 30 to 70 percent by weight relative to the weight of the color material layer. In the case where the coloring agent content is specified to be within the range of 20 to 80 percent by weight, desired lightfastness is obtained and the color optical density becomes good.

Preferably, the above-described color material layer 3 is formed by adding the coloring agents represented by Structural formula 1 to Structural formula 4 and other coloring agents, the binder resin, and as necessary, any other component, e.g., an organic filler and an inorganic filler, to an appropriate solvent, conducting dissolution or dispersion so as to prepare color material layer formation coating solutions, and applying the resulting coating solutions with desired widths and lengths to one surface 2*a* of the base material 2 on a color basis field-sequentially in the order of, for example, yellow, magenta, and cyan, as shown in FIG. 1, followed by drying.

The over coat layer 4 disposed side by side with the color material layer 3 is a transparent layer to be thermally transferred to the transfer receiving member 11 provided with the image, so as to cover the image, protect the image from light and the like, and improve the lightfastness of the image. This over coat layer 4 is disposed as necessary. The over coat layer 4 is formed from primarily a thermoplastic resin. As for the thermoplastic resin, it is preferable that a resin which satisfactorily adheres through heating and pressurizing to the transfer receiving member 11 provided with the image is used. Examples thereof include cellulose acetate butyrate resins, vinyl chloride-vinyl acetate copolymers, polyvinyl butyral resins, and polyester resins. The over coat layer 4 is blended with an ultraviolet absorbing agent and a light stabilizer in order to improve the lightfastness of the image.

Regarding the thermal transfer member 1, the over coat layer 4 is field-sequentially disposed following the color material layer 3. Therefore, the coloring agents of yellow, cyan, and magenta are transferred to the transfer receiving member 11 so as to form an image and succeedingly, the over coat layer 4 is thermally transferred. Consequently, the color image can be easily covered with the over coat layer 4, and the lightfastness of the image is improved because of this over coat layer 4, so that still higher fastness of the image can be obtained.

As shown in FIG. 1, in the thermal transfer member 1, the color material layers 3Y, 3M, and 3C of three colors, yellow, magenta, and cyan, and the over coat layer 4 are field-sequentially disposed, these color material layers 3Y, 3M, and 3C of three colors and the over coat layer 4 are assumed to constitute one set, and detection marks 5 for detecting this one set may be disposed adjacent to the yellow color material layer 3Y and the over coat layer 4.

In the above-described thermal transfer member 1, the color material layer 3 of the three colors, yellow, magenta, and cyan, or the four colors, in which black is added, are field-sequentially disposed on the base material 2, although not limited to this. Besides the yellow color material layer 3Y and the cyan color material layer 3C, not limited to the magenta color material layer 3M and the black color material layer, but fusion transfer type color material layers previously in the public domain may be disposed. For example, a plurality of desired color material layers of special colors may be disposed in accordance with applications.

Regarding the thermal transfer member 1, the configuration except that the color material layers 3Y, 3M, and 3C of mainly three primary colors are field-sequentially formed may be the same as the configuration of a thermal transfer member previously in the public domain.

It is not limited that the one surface 2*a* of the base material 2 is field-sequentially provided with the yellow color material layer 3Y, the magenta color material layer 3M, the cyan color material layer 3C, and the over coat layer 4, as described above. Merely one layer of yellow color material layer 3Y and one layer of cyan color material layer 3C may be disposed and, as necessary, one layer each of magenta color material layer 3M, black color material layer, and over coat layer 4 may be further disposed.

Moreover, on the one surface 2*a* of the base material 2, a transfer type coloring agent receiving layer for receiving coloring agents may be disposed at a position forward of the yellow color material layer 3Y in the movement direction of the thermal transfer member 1 in such a way that the transfer type coloring agent receiving layer is thermally transferred in the image formation region of the transfer receiving member 11 before the yellow coloring agent and the cyan coloring agent are thermally transferred. The transfer type coloring agent receiving layer is primarily formed from an acrylic resin having dyeing affinity for coloring agent. Regarding the thermal transfer member 1 having the above-described configuration, the transfer type coloring agent receiving layer is thermally transferred to the transfer receiving member 11 having no dyeing affinity for coloring agent before the coloring agents are thermally transferred and, thereafter, the coloring agents are thermally transferred, so that a color image can be formed on the transfer receiving member 11 having no dyeing affinity for coloring agent.

On the other hand, on the back surface 2*b*, which is not provided with the color material layer 3, of the base material 2, a heat-resistant lubricating layer, although not shown in the drawing, may be disposed with a primer layer therebetween, as necessary, for the purpose of preventing an occurrence of an adverse effect due to heat of the thermal head 12. For example, the heat-resistant lubricating layer can be formed from a layer in which reaction products of a polyvinyl butyral or a polyvinyl acetoacetal with isocyanate contain an alkali metal salt of phosphate ester, a surfactant of alkaline earth metal salt, and/or an aliphatic acid ester or an aliphatic acid ester salt. Furthermore, a filler, e.g., an organic filler or an inorganic filler, may be added to the heat-resistant lubricating layer.

Regarding the thermal transfer member 1 having the above-described configuration, the coating solutions of individual layers having desired widths and lengths are field-sequentially applied to the one surface 2*a* of the base material 2 in the order of the yellow color material layer 3Y, the magenta color material layer 3M, the cyan color material layer 3C, and the over coat layer 4, while the black color material layer and the transfer type coloring agent receiving layer are further included, as necessary, drying is conducted to form individual layers, cutting into an appropriate width and winding around a roll, e.g., a supply side spool 20, are conducted so that a product is made, and the product is incorporated into the above-described thermal transfer printer 10.

The transfer receiving member 11, to which the coloring agents are thermally transferred from the thermal transfer member 1, is not specifically limited insofar as the recording surface thereof has a coloring agent receiving property with respect to the above-described coloring agents of the thermal transfer member 1. However, paper, metals, glass, synthetic resins, and the like which have no coloring agent receiving property, can be used. In the case where the transfer receiving member 11 is formed from them, as described above, the transfer type coloring agent receiving layer may be formed on the transfer receiving member 11 by transferring the transfer type coloring agent receiving layer from the thermal transfer member 1, or a coloring agent receiving layer may be formed on at least a part of the surface of the transfer receiving member 11, that is, at least in the image formation region.

In order to obtain a photorealistic color image, it is preferable that the transfer receiving member 11 is in a sheet-like shape having a thickness of 50 to 500 μm, and preferably 100 to 300 μm. Examples of base materials include paper, various types of converted paper, and various types of plastic film. If necessary, different types of sheets can be used after being bonded together. In particular, in the case where a film having void layers in a base material or a member including a resin layer having voids on a base material is used, thermal sensitivity is improved and contact of the thermal head 12 can be obtained sufficiently.

Furthermore, the coloring agent receiving layer may be formed by applying a resin solution or a dispersion having the dyeing affinity for coloring agent to this base material followed by drying or laminating resin films having dyeing affinity for coloring agent. The thus formed coloring agent receiving layer may be formed from a single material or a plurality of materials and may contain various additives within the bounds of not impairing the desired lightfastness and heat resistance. The coloring agent receiving layer may have any thickness but is formed generally having a thickness of 1 to 50 μm, and preferably 2 to 10 μm.

Examples of resins for the coloring agent receiving layer include polyester resins, cellulose resins, vinyl resins, acrylic resins, epoxy resins, polyurethane resins, phenoxy resins, and polyamide resins. They may be used after mixing or copolymerization.

The transfer receiving member 11 provided with the above-described coloring agent receiving layer can be used on an "as is" basis satisfactorily. However, an organic filler, an inorganic filler, or the above-described mold-releasable graft copolymer or a mold release agent, which exhibits good mold releasability, may be added to the coloring agent receiving layer so as to be used in combination. Consequently, such a transfer receiving member 11 can conduct further excellent thermal transfer recording.

Furthermore, the dyeing affinity for coloring agent of the coloring agent receiving layer can be enhanced by addition of plasticizers, e.g., various resin oligomers and phthalate esters, so as to further increase the color optical density.

Moreover, the coloring agent receiving layer can contain optionally a white pigment, an ultraviolet absorbing agent, an antioxidant, a fluorescent brightener, and dyes and pigments for coloring the coloring agent receiving layer.

Regarding the transfer receiving member 11 having the above-described configuration, in the above-described thermal transfer printer 10, the thermal transfer member 1 is used, the yellow color material layer 3Y, the magenta color material layer 3M, and the cyan color material layer 3C of the thermal transfer member 1 are selectively sequentially heated with the thermal head 12 on the basis of the image data to thermally transfer the yellow coloring agent, the magenta coloring agent, and the cyan coloring agent to the transfer receiving member 11 sequentially and, thereby, form a color image, as described above. The over coat layer 4 is thermally transferred to the color image so as to form the color image covered with the over coat layer 4. The resulting color image is formed by, for example, color mixing of the yellow coloring agent and the magenta coloring agent.

Regarding the recording method conducted by using the above-described thermal transfer printer 10, the dicyanomethine based coloring agent represented by Structural formula 1 is contained in the yellow coloring agent of the transfer receiving member 11 and the indoaniline based coloring agent represented by Structural formula 2 is contained in the cyan coloring agent and, thereby, even when a mixed color is formed by mixing the yellow coloring agent and the cyan coloring agent, the interaction between the yellow coloring agent and the cyan coloring agent is low, deterioration of the coloring agent is reduced, a photorealistic color hard copy exhibiting excellent lightfastness and heat resistance can be formed, very excellent wide-range color reproducibility can be realized, and an image exhibiting excellent fastness properties can be formed.

In this recording method, the dicyanomethine based coloring agent represented by Structural formula 1 and the indoaniline based coloring agent represented by Structural formula 2 are used not only in the color mixture portion, but also in the single color portions of yellow and cyan and, thereby, an image exhibiting the lightfastness, the heat resistance, and the like and exhibiting excellent fastness properties can be formed likewise.

Moreover, in this recording method, in the case where the yellow coloring agent further contains disazo based coloring agent represented by Structural formula 3 besides the dicyanomethine based coloring agent represented by Structural formula 1 and the cyan coloring agent further contains anthraquinone based coloring agent represented by Structural formula 4 besides the indoaniline based coloring agent represented by Structural formula 2, an image exhibiting further lightfastness, heat resistance, and the like and exhibiting excellent fastness properties can be formed.

In the above-described recording method, the thermal transfer printer 10 provided with one thermal head serving as a heating device for heating the thermal transfer member 1 is used. However, a so-called tandem system thermal transfer printer provided with a plurality of heating devices, that is, a plurality of thermal heads, as described in Japanese Unexamined Patent Application Publication No. 2005-271361, may be used.

As is described in, for example, Japanese Unexamined Patent Application Publication No. 2005-271361, in the tandem system thermal transfer printer, a thermal head is provided for each of yellow, magenta, cyan, and over coat layers, these four thermal heads are arranged in series, and a thermal transfer member is provided on a thermal head basis, each thermal transfer member including merely one of a yellow color material layer, a magenta color material layer, a cyan color material layer, and an over coat layer corresponding to the thermal head. In this tandem system thermal transfer printer, the thermal heads of yellow, magenta, and cyan are driven in accordance with the recording signals to heat selectively the coloring agents of individual colors of the thermal transfer members fed into the printer, so that the coloring agents of yellow, magenta, and cyan are thermally transferred to the transfer receiving member. Thereafter, the thermal head of the over coat layer is heated and the over coat layer is thermally transferred to the color image formed from the coloring agents, so that a color image protected by the over coat layer is formed.

A thermal transfer member set composed of a plurality of types of thermal transfer members used for the tandem system thermal transfer printer has, for example, four types of thermal transfer members, each including merely one of a yellow color material layer, a magenta color material layer, a cyan color material layer, and an over coat layer on one surface of a base material. The thermal transfer member provided with the magenta color material layer and the thermal transfer member provided with the over coat layer are added, as necessary.

The configurations of the base material, the yellow color material layer, the magenta color material layer, the cyan color material layer, the over coat layer, and the like of the individual thermal transfer members in the thermal transfer member set are similar to those in the above-described thermal transfer member 1. The yellow color material layer contains the dicyanomethine based coloring agent represented by Structural formula 1 and, preferably the disazo based coloring agent represented by Structural formula 3 is further contained. The cyan color material layer contains the indoaniline based coloring agent represented by Structural formula 2 and, preferably the anthraquinone based coloring agent represented by Structural formula 4 is further contained.

The thermal transfer member set may be composed of a thermal transfer member in which a yellow color material layer and a magenta color material layer are field-sequentially disposed on one base material and a thermal transfer member in which a cyan color material layer and an over coat layer are field-sequentially disposed on another base material. In the thermal transfer member set, besides yellow and cyan, a black color material layer may be included in a separate thermal transfer member or be added to the yellow color material layer, the magenta color material layer, the cyan color material layer, and the over coat layer in the thermal transfer member. The black color material layer is the same as the black color material layer of the above-described thermal transfer member 1.

Regarding the thermal transfer members constituting the thermal transfer member set, at least one color material layer is disposed on one base material. In the case of a plurality of color material layers, any combination of colors is employed, and the color material layer and the over coat layer may be combined.

According to the recording method by using the tandem system thermal transfer printer including this thermal transfer member set, as in the recording method by using the above-described thermal transfer printer 10, even when a mixed color is formed by mixing the yellow coloring agent and the cyan coloring agent, the interaction between the yellow coloring agent and the cyan coloring agent is low, deterioration of the coloring agent is reduced, a photorealistic color hard copy exhibiting excellent lightfastness and heat resistance can be formed, very excellent wide-range color reproducibility can be realized, and an image exhibiting excellent fastness properties can be formed.

In this recording method as well, in the case where the dicyanomethine based coloring agent represented by Structural formula 1 and the indoaniline based coloring agent represented by Structural formula 2 are used not only in the color mixture portion, but also in the single color portions of yellow and cyan, an image exhibiting the lightfastness, the heat resistance, and the like and exhibiting excellent fastness properties can be formed likewise.

Moreover, in this recording method as well, in the case where the yellow coloring agent further contains disazo based coloring agent represented by Structural formula 3 and the cyan coloring agent further contains anthraquinone based coloring agent represented by Structural formula 4, an image exhibiting further lightfastness, heat resistance, and the like and exhibiting excellent fastness properties can be formed.

EXAMPLES

The thermal transfer member according to an embodiment of the present invention will be specifically described below with reference to examples and comparative examples. In the description, part or % refers to part by weight or percent by weight unless otherwise specified. First, examples and comparative examples in which each of the yellow coloring agent and the cyan coloring agent contains one type of coloring agent are described.

Example 1

In Example 1, the contents of a yellow coloring agent and a cyan coloring agent as shown in Table 1 were set as shown in Table 1, 3.6 parts of polyvinyl acetoacetal resin (KS-5 produced by Sekisui Chemical Co., Ltd.) serving as a binder resin, 48.2 parts of methyl ethyl ketone, and 48.2 parts of toluene were mixed, the coloring agents and the binder resin were dissolved or dispersed into a solvent, so as to prepare yellow color material layer and cyan color material layer formation coatings. The yellow color material layer formation coating and the cyan color material layer formation coating were applied to the surface of a polyethylene terephthalate film, which has a thickness of 6 μm and which is provided with a heat-resistant lubricating layer on the back surface, in such a way that the dried coating weight of each of the coatings becomes 1.0 g/m$^2$ and drying was conducted, so that a thermal transfer member was formed. The yellow coloring agent contained in the yellow color material layer was a dicyanomethine based coloring agent represented by Formula (1), that is, the dicyanomethine based coloring agent represented by Structural formula 1. The cyan coloring agent contained in the cyan color material layer is an indoaniline based coloring agent represented by Formula (7), that is, the indoaniline based coloring agent represented by Structural formula 2.

Example 2

In Example 2, a thermal transfer member was formed as in Example 1 except that a yellow coloring agent and a cyan coloring agent shown in Table 1 were used.

Comparative Example 1 and Comparative Example 2

In Comparative example 1 and Comparative example 2, thermal transfer members were formed as in Example 1 except that yellow coloring agents and cyan coloring agents shown in Table 1 were used.

TABLE 1

| | Yellow coloring agent | | Cyan coloring agent | | Cyan residual percentage (%) | Cyan residual percentage in green (%) | Difference in residual percentage (%) | ΔE Change in hue after test |
|---|---|---|---|---|---|---|---|---|
| Example 1 | Formula (1) | 3.6 parts | Formula (7) | 3.6 parts | 93.2 | 80.4 | 12.8 | 12.8 |
| Example 2 | Formula (1) | 3.6 parts | Formula (10) | 3.6 parts | 94.8 | 83.1 | 11.7 | 12.2 |
| Comparative example 1 | Formula (1) | 3.6 parts | Formula (11) | 3.6 parts | 95.2 | 75.7 | 19.5 | 18.4 |
| Comparative example 2 | Formula (1) | 3.6 parts | Formula (12) | 3.6 parts | 93.8 | 72.7 | 21.1 | 20.5 |

Next, examples and comparative examples in which the yellow coloring agent contains two types of coloring agents and the cyan coloring agent contains one type of coloring agent will be described.

Example 3 to Example 8

In Example 3 to Example 8, thermal transfer members were prepared as in Example 1 except that yellow coloring agents and cyan coloring agents shown in Table 2 were used, and the contents thereof were set as shown in Table 2.

Comparative Example 3 to Comparative Example 7

In Comparative example 3 to Comparative example 7, thermal transfer members were prepared as in Example 1 except that yellow coloring agents and cyan coloring agents shown in Table 2 were used, and the contents thereof were set as shown in Table 2.

Next, examples and comparative examples in which the yellow coloring agent contains three types of coloring agents and the cyan coloring agent contains two type of coloring agents will be described.

Example 9 to Example 11

In Example 9 to Example 11, thermal transfer members were prepared as in Example 1 except that yellow coloring agents and cyan coloring agents shown in Table 3 were used, and the contents thereof were set as shown in Table 3.

Comparative Example 8 to Comparative Example 10

In Comparative example 8 to Comparative example 10, thermal transfer members were prepared as in Example 1 except that yellow coloring agents and cyan coloring agents shown in Table 3 were used, and the contents thereof were set as shown in Table 3.

TABLE 2

| | Yellow coloring agent | | Cyan coloring agent | | Cyan residual percentage (%) | Cyan residual percentage in green (%) | Difference in residual percentage (%) | ΔE Change in hue after test |
|---|---|---|---|---|---|---|---|---|
| Example 3 | Formula (1)<br>Formula (3) | 1.2 parts<br>2.4 parts | Formula (8) | 3.6 parts | 94.8 | 93.1 | 1.7 | 3.3 |
| Example 4 | Formula (1)<br>Formula (3) | 1.2 parts<br>2.4 parts | Formula (9) | 3.6 parts | 96.3 | 94.9 | 1.4 | 3.3 |
| Example 5 | Formula (1)<br>Formula (3) | 1.2 parts<br>2.4 parts | Formula (10) | 3.6 parts | 96.6 | 94.8 | 1.8 | 3.5 |
| Example 6 | Formula (1)<br>Formula (4) | 1.2 parts<br>2.4 parts | Formula (9) | 3.6 parts | 95.9 | 94.4 | 1.5 | 3.7 |
| Example 7 | Formula (1)<br>Formula (4) | 1.2 parts<br>2.4 parts | Formula (10) | 3.6 parts | 96.2 | 94.1 | 2.1 | 3.6 |
| Example 8 | Formula (1)<br>Formula (5) | 1.2 parts<br>2.4 parts | Formula (8) | 3.6 parts | 96.0 | 94.0 | 2.0 | 3.1 |
| Comparative example 3 | Formula (1)<br>Formula (3) | 1.2 parts<br>2.4 parts | Formula (12) | 3.6 parts | 96.3 | 91.2 | 5.1 | 6.9 |
| Comparative example 4 | Formula (1)<br>Formula (3) | 1.2 parts<br>2.4 parts | Formula (13) | 3.6 parts | 95.0 | 86.9 | 8.1 | 7.6 |
| Comparative example 5 | Formula (1)<br>Formula (3) | 1.2 parts<br>2.4 parts | Formula (14) | 3.6 parts | 98.2 | 92.6 | 5.6 | 5.2 |
| Comparative example 6 | Formula (1)<br>Formula (4) | 1.2 parts<br>2.4 parts | Formula (15) | 3.6 parts | 97.7 | 91.5 | 6.2 | 6.2 |
| Comparative example 7 | Formula (1)<br>Formula (4) | 1.2 parts<br>2.4 parts | Formula (16) | 3.6 parts | 97.1 | 91.7 | 5.4 | 6.0 |

TABLE 3

| | Yellow coloring agent | | Cyan coloring agent | | Cyan residual percentage (%) | Cyan residual percentage in green (%) | Difference in residual percentage (%) | ΔE Change in hue after test |
|---|---|---|---|---|---|---|---|---|
| Example 9 | Formula (1)<br>Formula (3)<br>Formula (6) | 1.2 parts<br>1.2 parts<br>1.2 parts | Formula (8)<br>Formula (17) | 2.4 parts<br>1.2 parts | 97.1 | 93.6 | 3.5 | 3.9 |
| Example 10 | Formula (1)<br>Formula (4)<br>Formula (6) | 1.2 parts<br>1.2 parts<br>1.2 parts | Formula (10)<br>Formula (17) | 2.4 parts<br>1.2 parts | 96.9 | 93.8 | 3.1 | 4.6 |
| Example 11 | Formula (2)<br>Formula (3)<br>Formula (6) | 1.2 parts<br>1.2 parts<br>1.2 parts | Formula (10)<br>Formula (17) | 2.4 parts<br>1.2 parts | 94.4 | 90.9 | 3.5 | 4.4 |
| Comparative example 8 | Formula (1)<br>Formula (3)<br>Formula (6) | 1.2 parts<br>1.2 parts<br>1.2 parts | Formula (11)<br>Formula (17) | 2.4 parts<br>1.2 parts | 99.0 | 90.5 | 8.5 | 6.5 |
| Comparative example 9 | Formula (1)<br>Formula (4)<br>Formula (6) | 1.2 parts<br>1.2 parts<br>1.2 parts | Formula (13)<br>Formula (17) | 2.4 parts<br>1.2 parts | 95.9 | 89.9 | 6.0 | 6.9 |
| Comparative example 10 | Formula (2)<br>Formula (3)<br>Formula (6) | 1.2 parts<br>1.2 parts<br>1.2 parts | Formula (13)<br>Formula (17) | 2.4 parts<br>1.2 parts | 93.8 | 85.4 | 8.4 | 8.2 |

Coloring agents represented by Formula (1) to Formula (17) shown in Table 1 to Table 3 will be described below. Formula (1) and Formula (2) correspond to dicyanomethine based coloring agents represented by Structural formula 1. Formula (3) to Formula (5) correspond to disazo based coloring agents represented by Structural formula 3. Formula (6) does not correspond to any one of Structural formula 1 to Structural formula 4, but represents a coloring agent further added separately. Formula (7) to Formula (10) correspond to indoaniline based coloring agent represented by Structural formula 2. Formula (11) to Formula (16) do not correspond to any one of Structural formula 1 to Structural formula 4, but represent coloring agents used as comparative examples. Formula (17) corresponds to an anthraquinone based coloring agent represented by Structural formula 4.

Formula (1)

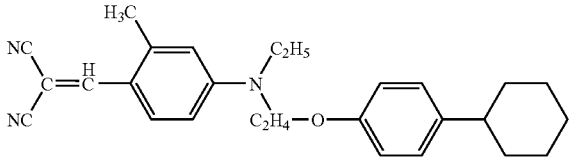

Formula (2)

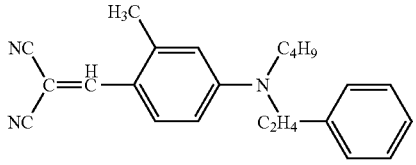

Formula (3)

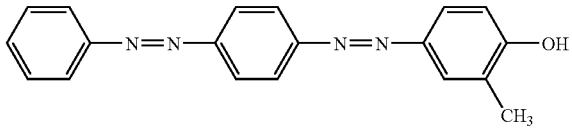

-continued

Formula (4)

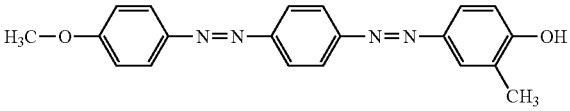

Formula (5)

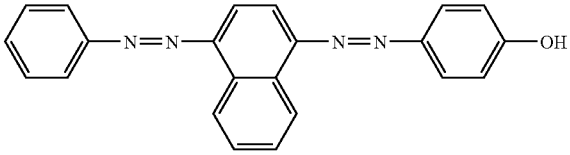

Formula (6)

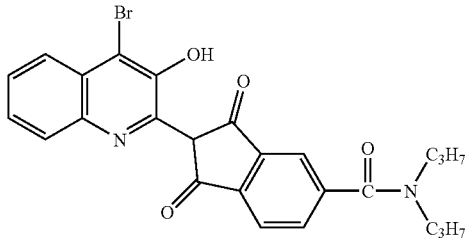

Formula (7)

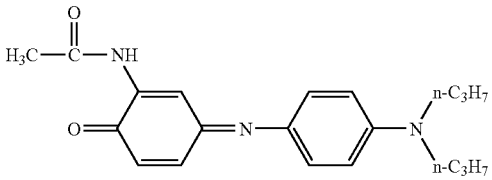

Formula (8)

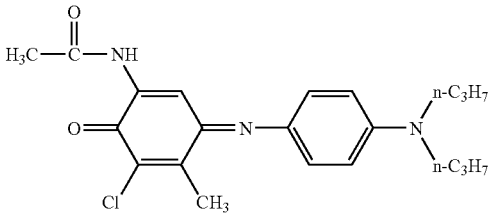

-continued

Formula (9)

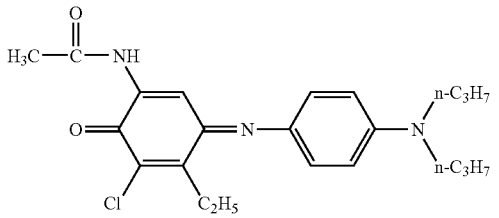

Formula (10)

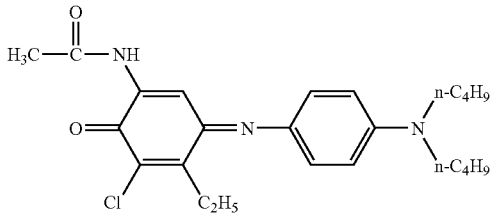

Formula (11)

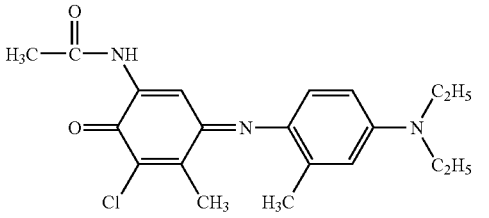

Formula (12)

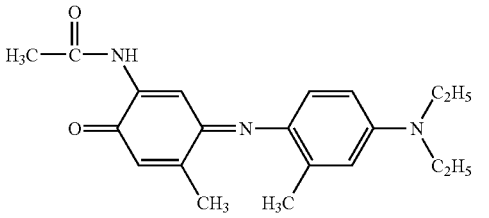

Formula (13)

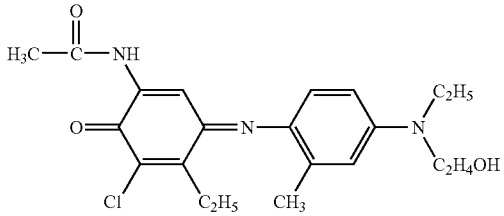

Formula (14)

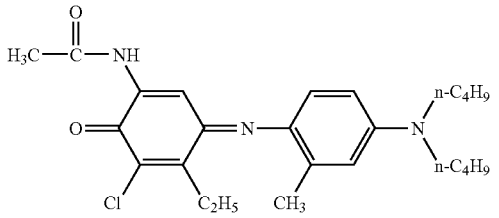

-continued

Formula (15)

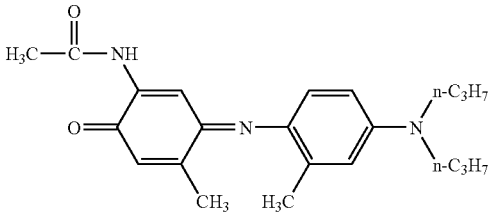

(Formula (16)

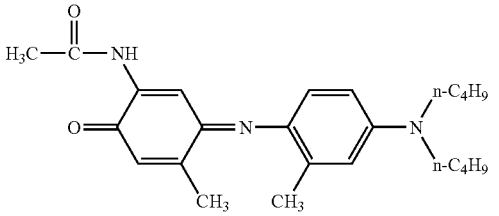

Formula (17)

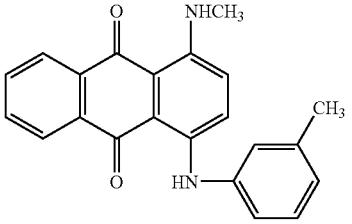

The thermal transfer members of Examples 1 to Example 11 and Comparative example 1 to Comparative example 10 prepared as described above and a digital photo printer UP-DR150 produced by Sony Corporation were used. Printing was conducted on a transfer receiving member for the printer, so as to obtain single color (yellow and cyan) and mixed color (green) printed materials. A transparent protective layer of a transfer member for the printer was formed by transfer.

As for a lightfastness test of the resulting printed material, Super Fluorescent Fade Meter produced by Suga Test Instruments Co., Ltd., was used, and an exposure test was conducted at an illuminance of 70,000 lux for 72 hr in an atmosphere at 24° C. and 60% RH. At that time, a spectrophotometer/densitometer SpectroEye produced by GretagMacbeth was used, and the density and the color difference of each color component in the vicinity of the density of 1.0 were measured before and after irradiation. The results thereof are shown in Table 1 to Table 3.

The difference in residual percentage shown in Table was determined on the basis of difference in residual percentage=(cyan density after fluorescent lamp irradiation/cyan density before fluorescent lamp irradiation)×100−(cyan component density in green after fluorescent lamp irradiation/cyan component density in green before fluorescent lamp irradiation)×100.

The change in hue after test was determined on the basis of $\Delta E$ (color difference)=SQR($(L^*_1-L^*_0)$^2+$(a^*_1-a^*_0)$^2+$(b^*_1-b^*_0)$^2). In the formula, L*, a*, and b* are color space coordinates defined by CIE (International Lighting Commission) 1976 color space, and regarding subscripts of L*, a*, and b*, 0 represents before fluorescent lamp irradiation and 1 represents after fluorescent lamp irradiation.

As is clear from the results shown in Table 1, regarding Comparative example 1 and Comparative example 2, the yellow coloring agent contains the coloring agent represented by Formula (1), that is, the dicyanomethine based coloring agent represented by Structural formula 1, and the cyan coloring agent contains coloring agents represented by Formula (11) and Formula (12), but the indoaniline based coloring agent represented by Structural formula 2 is not contained, an interaction thereby occurs between the yellow coloring agent and the cyan coloring agents, the cyan coloring agents deteriorate, the difference in residual percentage between cyan alone and the cyan component in green and the color difference (change in hue) between before and after the fluorescent lamp irradiation increase, so that the lightfastness of cyan in green is slightly poor. It is clear that in the case where the dicyanomethine based coloring agent represented by Structural formula 1 is used alone as in Comparative example 1 and Comparative example 2, the lightfastness of cyan in green is slightly poor.

In contrast to Comparative example 1 and Comparative example 2, in Example 1 and Example 2, the yellow coloring agent contains the coloring agent represented by Formula (1), that is, the dicyanomethine based coloring agent represented by Structural formula 1, and the cyan coloring agent contains the coloring agent represented by Formula (7) or Formula (10), that is, the indoaniline based coloring agent represented by Structural formula 2. Consequently, an interaction between the yellow coloring agent and the cyan coloring agent is suppressed, deterioration of the cyan coloring agent is suppressed, the difference between the residual percentage of cyan alone and the residual percentage of the cyan component in green becomes small, and the change in hue becomes also small. Therefore, it is clear that the lightfastness of cyan coloring agent in green is excellent.

As is clear from the results shown in Table 2, even in the case where two types of coloring agents are used as the yellow coloring agent and one type of coloring agent is used as the cyan coloring agent, in Comparative example 3 to Comparative example 7, the cyan coloring agents contains coloring agents represented by Formula (12) to Formula (16) but the indoaniline based coloring agent represented by Structural formula 2 is not contained, so that an interaction occurs between the yellow coloring agents and the cyan coloring agent, the cyan coloring agent deteriorates, the difference in residual percentage and the change in hue of the cyan component thereby increase, and the lightfastness of cyan coloring agent in green is slightly poor.

In contrast to Comparative example 3 to Comparative example 7, in Example 3 to Example 8, the yellow coloring agent contains the coloring agent represented by Formula (1), that is, the dicyanomethine based coloring agent represented by Structural formula 1 and the coloring agent represented by Formula (3), that is, the disazo based coloring agent represented by Structural formula 3, and the cyan coloring agents contain the coloring agents represented by Formula (8) to Formula (10), that is, the indoaniline based coloring agents represented by Structural formula 2. Consequently, an interaction between the yellow coloring agents and the cyan coloring agent is suppressed, deterioration of the cyan coloring agent is suppressed, and the difference in residual percentage and the change in hue of the cyan component become small. Therefore, it is clear that the lightfastness of the cyan coloring agent in green is excellent.

As is clear from the results shown in Table 2, in the case where the dicyanomethine based coloring agent represented by Structural formula 1 and the disazo based coloring agent represented by Structural formula 3 are used as the yellow coloring agent and the indoaniline based coloring agent represented by Structural formula 2 is used as the cyan coloring agent, since specific two types of coloring agents are contained in the yellow coloring agent, the difference in residual percentage and the change in hue of the cyan component become small as compared with those of Example 1 and Example 2 in which merely one type of coloring agent is contained, and it is clear that the lightfastness of cyan component is further excellent.

As is clear from the results shown in Table 3, even in the case where three types of coloring agents are used as the yellow coloring agent and two types of coloring agents are used as the cyan coloring agent, in Comparative example 8 to Comparative example 10, the cyan coloring agents contain the coloring agent represented by Formula (17), that is, the anthraquinone based coloring agent represented by Structural formula 4 is contained, but the indoaniline based coloring agent represented by Structural formula 2 is not contained, so that an interaction occurs between the yellow coloring agents and the cyan coloring agents, the cyan coloring agents deteriorate, the difference in residual percentage and the change in hue of the cyan component thereby increase, and it is clear that the lightfastness of the cyan coloring agent in green is slightly poor.

In contrast to Comparative example 8 to Comparative example 10, in Example 9 to Example 11, the yellow coloring agent contains the coloring agent represented by Formula (6) besides the coloring agent represented by Formula (1), that is, the dicyanomethine based coloring agent represented by Structural formula 1 and the coloring agent represented by Formula (3), that is, the disazo based coloring agent represented by Structural formula 3, and the cyan coloring agents contain the coloring agents represented by Formula (8) and Formula (10), that is, the indoaniline based coloring agents represented by Structural formula 2 and the coloring agent represented by Formula (17), that is, the anthraquinone based coloring agent represented by Structural formula 4. Consequently, an interaction between the yellow coloring agents and the cyan coloring agents is suppressed, deterioration of the cyan coloring agents is suppressed, and the difference in residual percentage and the change in hue of the cyan component become small. Therefore, it is clear that the lightfastness of the cyan coloring agent in green is excellent.

As is clear from the results shown in Table 3, even in the case where the yellow coloring agent contains the dicyanomethine based coloring agent represented by Structural formula 1, the disazo based coloring agent represented by Structural formula 3, and furthermore the coloring agent represented by Formula (6) besides the above-described specific coloring agents, interactions between the yellow coloring agents and the cyan coloring agents are suppressed, and deterioration of the cyan coloring agent is suppressed. Moreover, as is clear from the results shown in Table 3, in the case where the coloring agents represented by Structural formula 1 and Structural formula 3 are contained in the yellow coloring agent, the indoaniline based coloring agent represented by Structural formula 2 and the anthraquinone based coloring agent represented by Structural formula 4 are contained in the cyan coloring agent and, therefore, each of the yellow coloring agent and the cyan coloring agent contains specific two types of coloring agents, the difference in residual percentage and the change in hue of the cyan component become smaller as compared with those of Example 1 and Example 2 in which merely one type of coloring agent is contained. Consequently, it is clear that the lightfastness of cyan coloring agent in green is excellent.

As described above, in the case where the difference in residual percentage of each color component in the mixed color is reduced, regarding a color image, color fading balance between individual colors can be kept as compared with that in the case where the residual percentage of a single color is allowed to increase simply, so as to increase the life of the color image.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer member comprising:

a plurality of color material layers on one surface of a base material, wherein at least one of the color material layers contains a dicyanomethine based coloring agent represented by Structural formula 1 and at least one of the other color material layers contains an indoaniline based coloring agent represented by Structural formula 2.

Structural formula 1

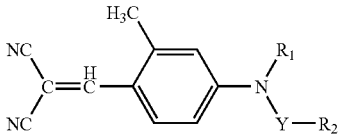

Where $R_1$ represents an alkyl group, Y represents —$C_2H_4$— or —$C_2H_4O$—, and $R_2$ represents a substituted or unsubstituted aryl group.

Structural formula 2

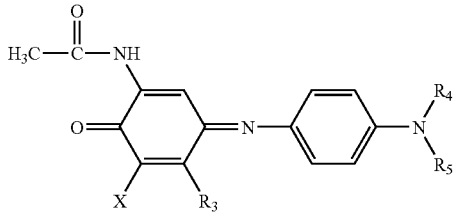

Where X represents a halogen atom or a hydrogen atom, $R_3$, $R_4$, and $R_5$ represent independently an alkyl group having the carbon number of 1 to 4.

2. The thermal transfer member according to claim 1, wherein among the plurality of color material layers, at least one of the remainder color material layers contains a magenta coloring agent.

3. The thermal transfer member according to claim 1, wherein among the plurality of color material layers, at least one of the remainder color material layers is a color material layer having a black hue, and the black hue of the color material layer attributes to a single coloring agent or mixing of a plurality of types of coloring agents.

4. The thermal transfer member according to claim 1, comprising an overcoat layer for transfer besides the plurality of color material layers on the one surface of the base material.

5. The thermal transfer member according to claim 1, wherein the plurality of color material layers or the plurality of color material layers and the overcoat layer for transfer are field-sequentially disposed on one surface of the base material.

6. A thermal transfer member comprising:

a plurality of color material layers on one surface of a base material, wherein at least one of the color material layers contains a dicyanomethine based coloring agent represented by Structural formula 1 and a disazo based coloring agent represented by Structural formula 3 and at least one of the other color material layers contains an indoaniline based coloring agent represented by Structural formula 2 and an anthraquinone based coloring agent represented by Structural formula 4.

Structural formula 1

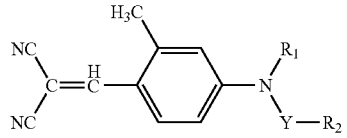

Where $R_1$ represents an alkyl group, Y represents —$C_2H_4$— or —$C_2H_4O$—, and $R_2$ represents a substituted or unsubstituted aryl group.

Structural formula 2

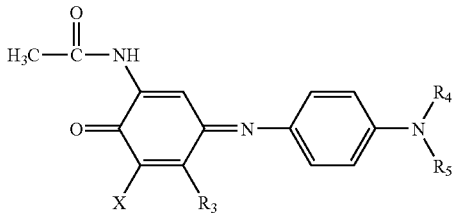

Where X represents a halogen atom or a hydrogen atom, $R_3$, $R_4$, and $R_5$ represent independently an alkyl group having the carbon number of 1 to 4.

Structural formula 3

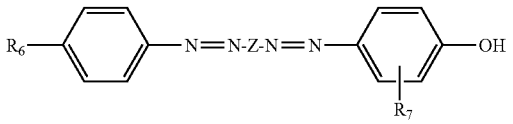

Where $R_6$ represents a hydrogen atom or an alkoxy group, Z represents a 1,4-phenylene group or a 1,4-naphthalene group, and $R_7$ represents a hydrogen atom or an alkyl group having the carbon number of 1 to 4.

Structural formula 4

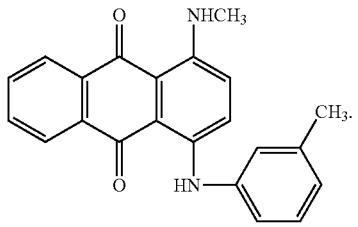

7. A recording method comprising the step of:

heating color material layers of a thermal transfer member, in which a plurality of color material layers containing coloring agents are disposed on a base material, selectively in accordance with recording signals with a recording head so as to thermally transfer and record the coloring agents to a transfer receiving member, wherein at least one of the color material layers of the thermal transfer member contains a dicyanomethine based coloring agent represented by Structural formula 1 and at least one of the other color material layers contains an indoaniline based coloring agent represented by Structural formula 2.

Structural formula 1

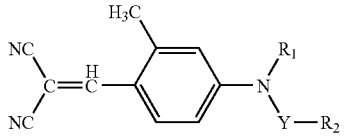

Where $R_1$ represents an alkyl group, Y represents —$C_2H_4$— or —$C_2H_4O$—, and $R_2$ represents a substituted or unsubstituted aryl group.

Structural formula 2

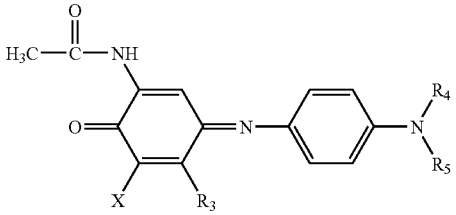

Where X represents a halogen atom or a hydrogen atom, $R_3$,$R_4$, and $R_5$ represent independently an alkyl group having the carbon number of 1 to 4.

8. The recording method according to claim 7, wherein among the plurality of color material layers, at least one of the remainder color material layers contains a magenta coloring agent.

9. The recording method according to claim 7, wherein among the plurality of color material layers, at least one of the remainder color material layers is a color material layer having a black hue, and the black hue of the color material layer attributes to a single coloring agent or mixing of a plurality of types of coloring agents.

10. The recording method according to claim 7, wherein an overcoat layer for transfer besides the plurality of color material layers is disposed on the one surface of the base material.

11. The recording method according to claim 7, wherein the plurality of color material layers or the plurality of color material layers and the overcoat layer for transfer are field-sequentially disposed on one surface of the base material.

12. A recording method comprising the step of:

heating color material layers of a thermal transfer member, in which a plurality of color material layers containing coloring agents are disposed on a base material, selectively in accordance with recording signals with a recording head so as to thermally transfer and record the coloring agents on a transfer receiving member, wherein at least one of the color material layers contains a dicyanomethine based coloring agent represented by Structural formula 1 and a disazo based coloring agent represented by Structural formula 3 and at least one of the other color material layers contains an indoaniline based coloring agent represented by Structural formula 2 and an anthraquinone based coloring agent represented by Structural formula 4.

Structural formula 1

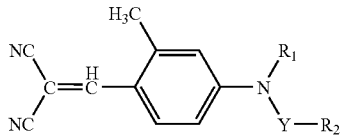

Where $R_1$ represents an alkyl group, Y represents —$C_2H_4$— or —$C_2H_4O$—, and $R_2$ represents a substituted or unsubstituted aryl group.

Structural formula 2

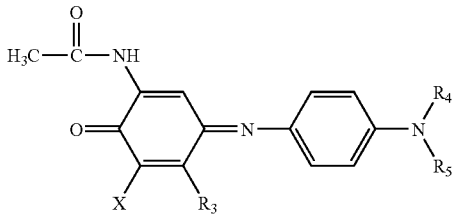

Where X represents a halogen atom or a hydrogen atom, $R_3$, $R_4$, and $R_5$ represent independently an alkyl group having the carbon number of 1 to 4.

Structural formula 3

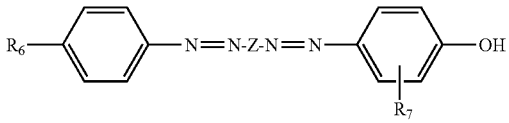

Where $R_6$ represents a hydrogen atom or an alkoxy group, Z represents a 1,4-phenylene group or a 1,4-naphthalene group, and $R_7$ represents a hydrogen atom or an alkyl group having the carbon number of 1 to 4.

Structural formula 4

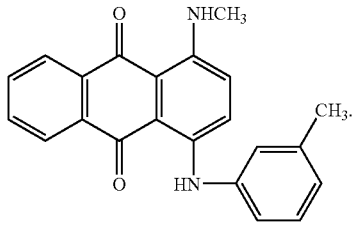

13. A thermal transfer member set comprising:

a plurality of types of thermal transfer members, in which at least one color material layer containing a coloring agent is disposed on one surface of a base material and which correspond to a plurality of recording heads including a plurality of heater elements, wherein at least one of the color material layers contains a dicyanomethine based coloring agent represented by Structural formula 1 and at least one of the other color material layers contains an indoaniline based coloring agent represented by Structural formula 1

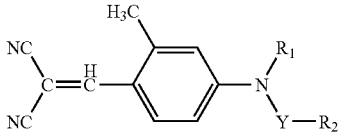

Where $R_1$ represents an alkyl group, Y represents —$C_2H_4$— or —$C_2H_4O$—, and $R_2$ represents a substituted or unsubstituted aryl group.

-continued

Structural formula 2

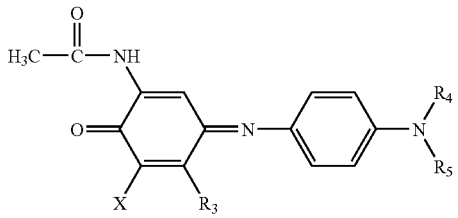

Where X represents a halogen atom or a hydrogen atom, $R_3$, $R_4$, and $R_5$ represent independently an alkyl group having the carbon number of 1 to 4.

14. A thermal transfer member set comprising:

a plurality of types of thermal transfer members, in which at least one color material layer containing a coloring agent is disposed and which correspond to a plurality of recording heads including a plurality of heater elements, wherein at least one of the color material layers contains a dicyanomethine based coloring agent represented by Structural formula 1 and a disazo based coloring agent represented by Structural formula 3 and at least one of the other color material layers contains an indoaniline based coloring agent represented by Structural formula 2 and an anthraquinone based coloring agent represented by Structural formula 4.

Structural formula 1

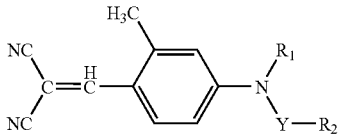

Where $R_1$ represents an alkyl group, Y represents —$C_2H_4$— or —$C_2H_4O$—, and $R_2$ represents a substituted or unsubstituted aryl group.

Structural formula 2

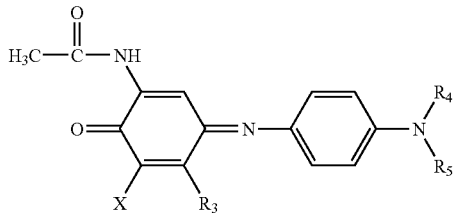

Where X represents a halogen atom or a hydrogen atom, $R_3$, $R_4$, and $R_5$ represent independently an alkyl group having the carbon number of 1 to 4.

Structural formula 3

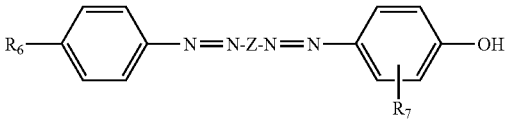

Where $R_6$ represents a hydrogen atom or an alkoxy group, Z represents a 1,4-phenylene group or a 1,4-naphthalene group, and $R_7$ represents a hydrogen atom or an alkyl group having the carbon number of 1 to 4.

-continued

Structural formula 4

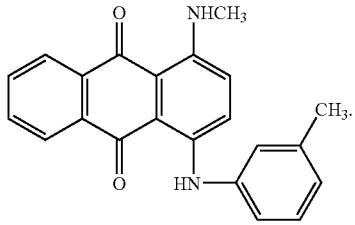

15. A recording method by using a plurality of recording heads including a plurality of heater elements, the method comprising the step of:

preparing a plurality of types of thermal transfer members, in which at least one color material layer is disposed on one surface of a base material; and heating the resulting thermal transfer members selectively in accordance with recording signals with recording heads corresponding to the individual thermal transfer members so as to thermally transfer and record coloring agents on a transfer receiving member, wherein at least one of the color material layers contains a dicyanomethine based coloring agent represented by Structural formula 1 and at least one of the other color material layers contains an indoaniline based coloring agent represented by Structural formula 2.

Structural formula 1

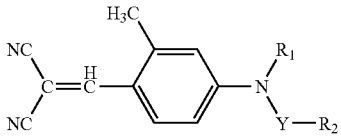

Where $R_1$ represents an alkyl group, Y represents —$C_2H_4$— or —$C_2H_4O$—, and $R_2$ represents a substituted or unsubstituted aryl group.

Structural formula 2

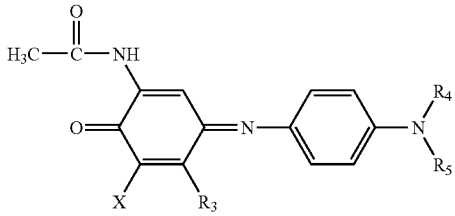

Where X represents a halogen atom or a hydrogen atom, $R_3$,$R_4$, and $R_5$ represent independently an alkyl group having the carbon number of 1 to 4.

* * * * *